US012391465B2

(12) United States Patent
Couch

(10) Patent No.: US 12,391,465 B2
(45) Date of Patent: Aug. 19, 2025

(54) MODULAR ENGINE SHIPPING SKID

(71) Applicant: Cummins Inc., Columbus, IN (US)

(72) Inventor: Chad M. Couch, Franklin, IN (US)

(73) Assignee: Cummins Inc., Columbus, IN (US)

( * ) Notice: Subject to any disclaimer, the term of this patent is extended or adjusted under 35 U.S.C. 154(b) by 175 days.

(21) Appl. No.: 17/661,139

(22) Filed: Apr. 28, 2022

(65) Prior Publication Data

US 2022/0250831 A1 Aug. 11, 2022

Related U.S. Application Data

(63) Continuation of application No. PCT/US2020/055212, filed on Oct. 12, 2020.

(60) Provisional application No. 62/933,629, filed on Nov. 11, 2019.

(51) Int. Cl.

| | |
|---|---|
| ***B65D 85/68*** | (2006.01) |
| ***B65D 19/38*** | (2006.01) |
| ***B65D 19/44*** | (2006.01) |

(52) U.S. Cl.

CPC ..... *B65D 85/68* (2013.01); *B65D 19/385* (2013.01); *B65D 19/44* (2013.01); *B65D 2519/00323* (2013.01); *B65D 2519/00542* (2013.01); *B65D 2519/00676* (2013.01); *B65D 2519/00815* (2013.01); *B65D 2519/0097* (2013.01); *B65D 2585/6877* (2013.01)

(58) Field of Classification Search

CPC ..... B65D 85/68; B65D 2585/68; B65D 2585/6802; B65D 2585/6875; B65D 2585/6877; B65D 19/44; B65D 19/385

USPC ..... 206/319, 386

See application file for complete search history.

(56) References Cited

U.S. PATENT DOCUMENTS

| | | | | |
|---|---|---|---|---|
| 1,600,835 A | | 9/1926 | Manley | |
| 3,304,109 A | | 2/1967 | Schuster | |
| 4,015,710 A | * | 4/1977 | Biggs | B65D 19/44 248/346.02 |
| 4,186,841 A | | 2/1980 | Buckley et al. | |
| 4,735,310 A | * | 4/1988 | Lemery | B65D 81/07 108/53.5 |
| 4,907,695 A | * | 3/1990 | Gomes | B65D 19/44 206/386 |
| 4,915,033 A | | 4/1990 | Bond | |
| 5,505,425 A | | 4/1996 | Shelton | |
| 6,006,676 A | | 12/1999 | Creek et al. | |

(Continued)

FOREIGN PATENT DOCUMENTS

WO 2008011147 A1 1/2008

OTHER PUBLICATIONS

International Search Report and Written Opinion, PCT Appln. No. PCT/US20/55212, Jan. 11, 2021, 9 pgs.

(Continued)

*Primary Examiner* — Steven A. Reynolds

(57) ABSTRACT

A modular shipping skid for an engine is provided. The skid includes a base sized to receive an engine thereon, at least one alignment member projecting from the base, and a plurality of vertically extending support members extending from the base. The skid includes a fixture plate having an opening to fit a profile of the at least one alignment member and secure the fixture plate onto the base. The engine is mounted to a fixture on the fixture plate, and different fixture plates are provided with different fixtures to accommodate different sized engines on the same base.

19 Claims, 7 Drawing Sheets

(56) References Cited

U.S. PATENT DOCUMENTS

| | | | | |
|---|---|---|---|---|
| 7,237,758 | B2 | 7/2007 | Nikolic | |
| 7,416,092 | B2 | 8/2008 | Dubois et al. | |
| 8,851,441 | B2 | 10/2014 | Acuna et al. | |
| 8,857,781 | B2 | 10/2014 | Wang et al. | |
| 2009/0300893 | A1* | 12/2009 | Herrmann ..... | H05K 5/0078 24/595.1 |
| 2010/0025179 | A1 | 2/2010 | Behrens | |
| 2018/0073672 | A1 | 3/2018 | Varner et al. | |

OTHER PUBLICATIONS

Examination Report, UK Application No. GB2206198.0, Apr. 12, 2023, 2 pgs.

* cited by examiner

MODULAR ENGINE SHIPPING SKID

CROSS-REFERENCE TO RELATED APPLICATIONS

The present application is a continuation of PCT Application No. PCT/US20/55212 filed on Oct. 12, 2020, which claims the benefit of the filing date of U.S. Provisional App. Ser. No. 62/933,629 filed on Nov. 11, 2019, each of which are incorporated herein by reference.

BACKGROUND

The present disclosure relates generally to internal combustion engines, and more particularly, but not exclusively, to a modular engine shipping skid. Generally, skids are product specific with limited use, particularly when product demands shift and undergo changes from year to year. Product specific skids may require excessive skid redesign or replacement due to limited flexibility in accommodating different products. Current skid proliferation has created gaps in engine delivery packaging solutions, forcing the use of wood pallets. The current drawbacks are causing a deviation in finish goods shipping methods based on customer demand and volume. Therefore, further improvements in this technology area are needed to address these issues, among others.

SUMMARY

The present disclosure includes a unique arrangement for a modular shipping skid configured to support internal combustion engines having a range of various sizes. In one embodiment, the skid includes a base sized to receive the engine thereon, at least one alignment member projecting from the base, and a plurality of vertically extending support members extending from the base. The skid includes a fixture plate having an opening provided thereon to fit a profile of the at least one alignment member and secure the fixture plate onto the base.

This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

BRIEF DESCRIPTION OF THE DRAWINGS

The description herein makes reference to the accompanying drawings wherein like numerals refer to like parts throughout the several views, and wherein.

DETAILED DESCRIPTION OF ILLUSTRATIVE EMBODIMENTS

For the purposes of clearly, concisely and exactly describing illustrative embodiments of the present disclosure, the manner and process of making and using the same, and to enable the practice, making and use of the same, reference will now be made to certain exemplary embodiments, including those illustrated in the figures, and specific language will be used to describe the same. It shall nevertheless be understood that no limitation of the scope of the invention is thereby created, and that the invention includes and protects such alterations, modifications, and further applications of the exemplary embodiments as would occur to one skilled in the art.

The present disclosure relates to a modular shipping skid for an engine. In certain embodiments, a modular skid may be used with various product ranges as compared to current product specific skid designs. The modular skids may reduce current lead times to manage shipping needs, model year change, product redesign, and skid maintenance or rework.

The modular shipping skid may include a modular base and a fixture plate removeably attached to the base. The fixture plate is provided with a fixture that is configured to support a specific sized engine. If a different sized engine is to be shipped, a different fixture plate and fixture can be provided that is used on the same base. Therefore, a single base can be employed to ship engines of various sizes by changing out the fixture plate on the base.

Figure 1:
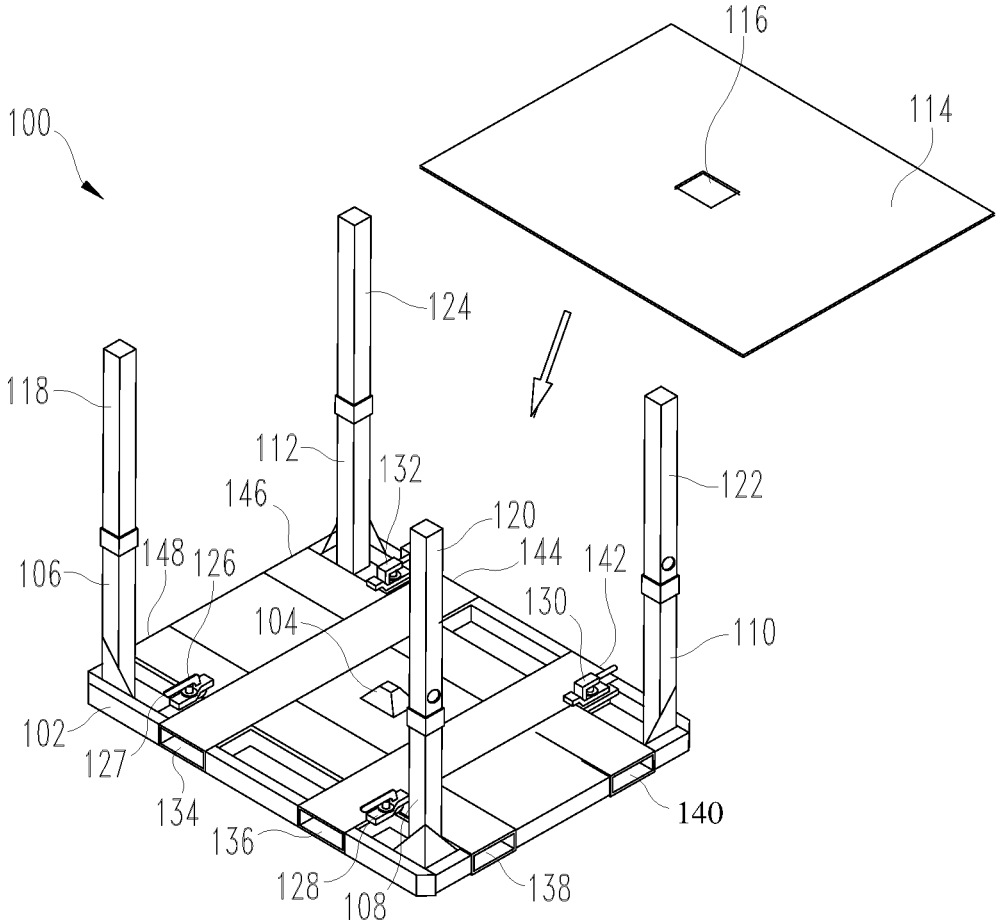
FIG. 1 is an exploded perspective view of a shipping skid, according to an embodiment of the present disclosure.

With reference to FIG. 1, there is illustrated an exploded perspective view of a shipping skid 100. The shipping skid 100 includes a base 102 sized to receive an engine (not shown), an alignment member 104 projecting from the base 102, vertically extending support members 106, 108, 110, 112 extending from the base 102, and a fixture plate 114 configured with an opening 116 provided thereon to fit a profile of the alignment member 104 and secure the fixture plate 114 onto the base 102. In the example implementation, the base 102 may be rectangular with a plurality of outer corners that each include a support member. Other example implementations of the base 102 may be contemplated such as, but not limited to, a square in which all four sides of the base may be the same length, and non-rectangular shapes.

The outer corners of the base 102 may each include a respective one of the vertically extending support members 106, 108, 110, 112. The base 102 includes four sides and each of the four sides may include one or more of the entry slots 134, 136, 138, 140, 142, 144, 146, 148 each having an entrance that is parallel to the fixture plate 114 to receive a lifting plate (not shown) for lifting the base 102. For example, the slots of base 102 may be configured to receive forks from a forklift to provide access capability for lifting and moving the shipping skid 100 and/or base 102.

The shipping skid 100 may include a number of locking mechanisms 126, 128, 130, and 132 to lock the fixture plate 114 to the base 102. The locking mechanisms 126, 128, 130, and 132 may each include a pin, such as pin 127 of locking mechanism 126, or similar attaching device that attaches to the base 102 and is configured to move from a first position, allowing the fixture plate 114 to be placed on the base 102, to a second position that extends over the fixture plate 114 to secure the fixture plate 114 to the base 102. For example, the pin 127 may be spring-loaded toward a locking position that projects outwardly from the outer frame of base 102 to extend over an upper surface of the fixture plate 114 to secure the fixture plate 114 to the base 102. The pin 127 can be retracted from the locking position to allow placement of the fixture plate 114 on base 102. In one embodiment, the locking mechanisms 126, 128, 130, 132 are latches with a spring-loaded plunger type pin that is movable into a retracted position in a housing for placement of fixture plate 114 and then is biased to extend outwardly when released to secure the fixture plate 114 on base 102. Locking mechanisms 126, 128, 130, 132 can also be moved to other locations on base 102, such as on the ends of base 102 between entry slots 138, 140 and between entry slots 146, 148.

Figure 2:
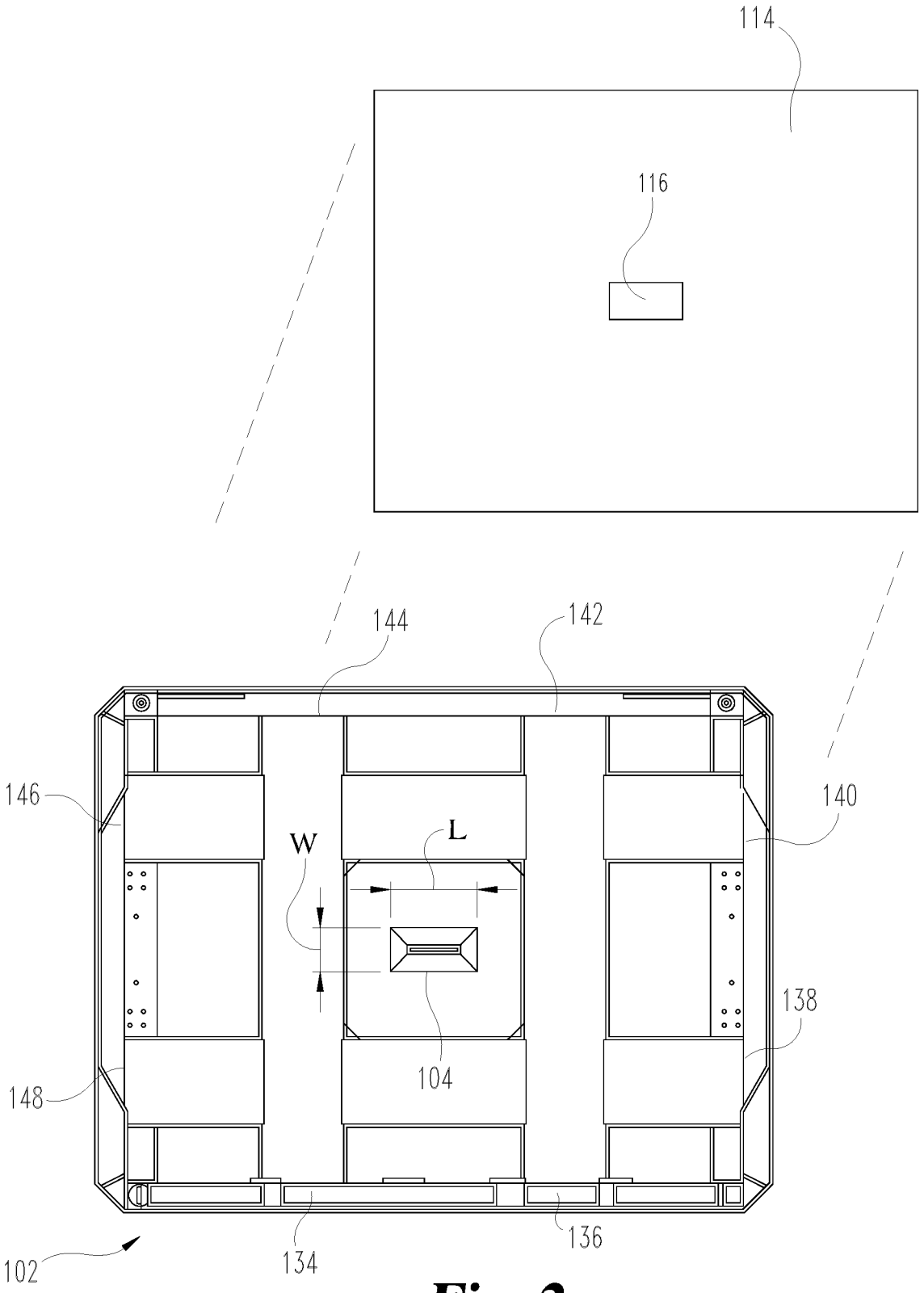
FIG. 2 is an exploded plan view of the shipping skid.

With reference to FIG. 2, there is illustrated an exploded plan view of the base 102 and the fixture plate 114. The base 102 is configured to accept a range of engines of different sizes from light to heavy-duty engines to increase automated process efficiency and freight optimization. According to an aspect of the present disclosure, different fixture plates 114 may be provided for each of various sizes of engines, and used with the same base 102. In one implementation, a range of engine sizes for light-duty engines may extend from 2.8 L to 4.5 L that are used with different fixture plates 114 and are able to be mounted on a common base 102 configured for light-duty engines. A mid-range of engine sizes according to another implementation may extend from 5.9 L to 9 L that are used with different fixture plates 114 and are able to be mounted on a common base 102 configured for mid-range engines. In yet another implementation, a range of heavy-duty engine sizes may extend from 12 L to 19 L that are used with different fixture plates 114 and are able to be mounted on a common base 102 configured for heavy duty engines.

In FIG. 2, the alignment member 104 is shown in the center of the base 102 and is configured to provide consistent engine orientation. The fixture plate 114 includes the opening 116 to align with the alignment member 104 and secure the fixture plate 114 onto the base 102. The alignment member 104 may include a length L extending along the base 102, a width W extending across the base 102, and a height H (FIG. 3A) extending vertically from the base 102. In one implementation, at least one of the width W and the length L tapers upwardly along the height H. In another implementation, each of the width W and the length L tapers upwardly along the height H. Other embodiments contemplate more than one alignment member 104 is provided. The alignment member 104 may be, for example, frusto-conically shaped, cone-shaped member, dowel or pin shaped, or other suitable shape for receiving and securing fixture plate 114 on the base 102 so that fixture plate 114 does not slide or rotate on base 102.

Figure 3A:
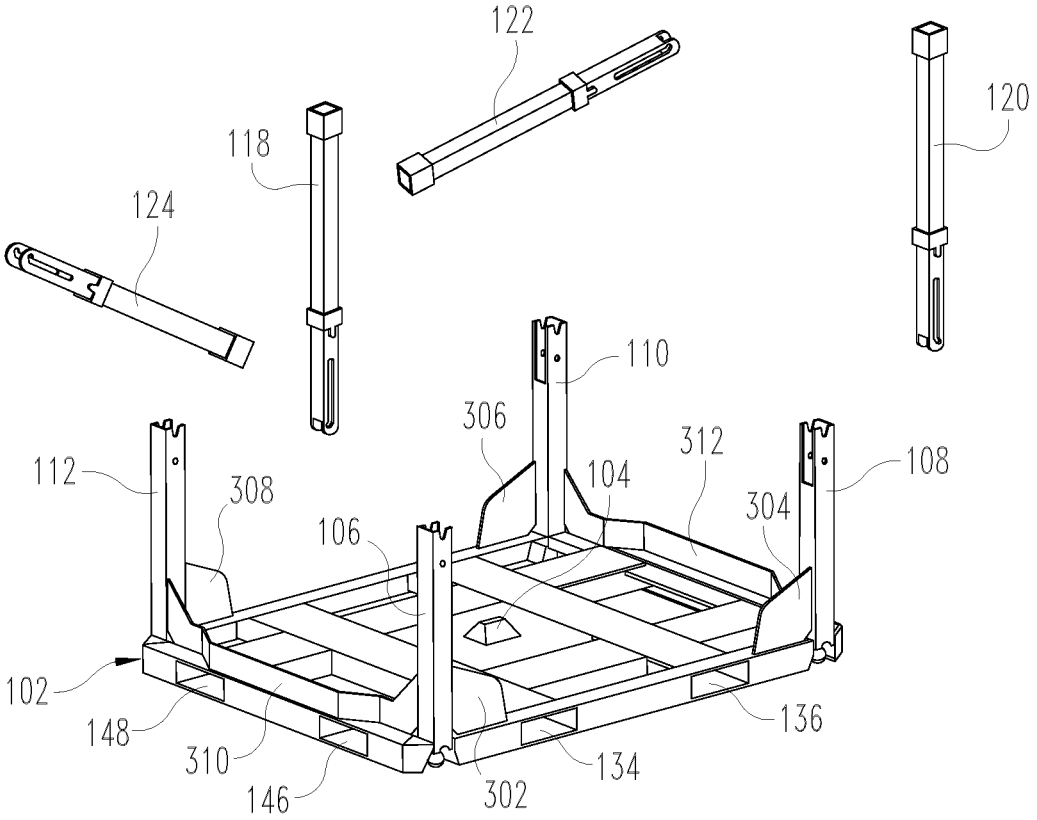
FIGS. 3A and 3B are a perspective view and a plan view, respectively, of a modular base of the shipping skid, including vertically extending support members and their respective detachable vertical post members.
Figure 3B:
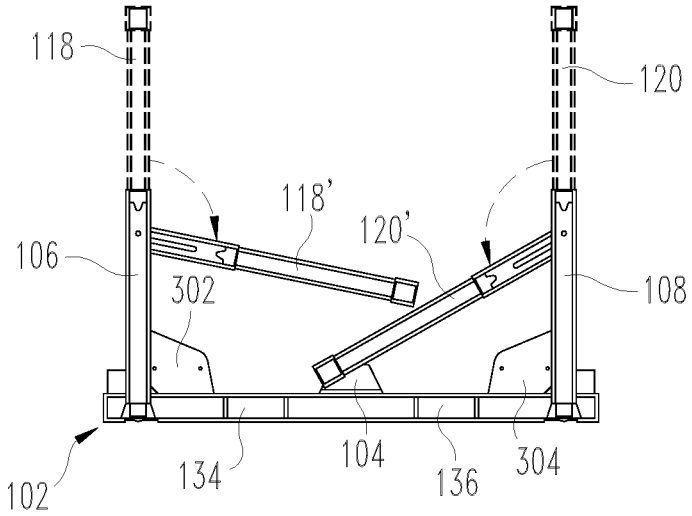

With reference to FIGS. 3A and 3B, there are illustrated an exploded perspective view and an elevation view of the vertically extending support members 106, 108, 110, 112 extending from the base 102. As shown in FIG. 3A, each of the support members 106, 108, 110, 112 includes a detachable or pivotal vertical post member 118, 120, 122, 124 that is adjustable relative to the respective vertical support member 106, 108, 110, 112 to one or more positions. The post members 118, 120, 122, 124 may be collapsible, pivotal, or otherwise moveable relative to the respective support member 106, 108, 110, 112 to improve packaging and shipping needs. In FIG. 3B, vertical post members 118' and 120' are illustrated in a collapsed position. The vertically extending support members 106, 108, 110, 112 may also include respective gusset plates 302, 304, 306, 308 or a similar fastening member to maintain the vertically extending support members 106, 108, 110, 112 in an upright position.

Figure 4:
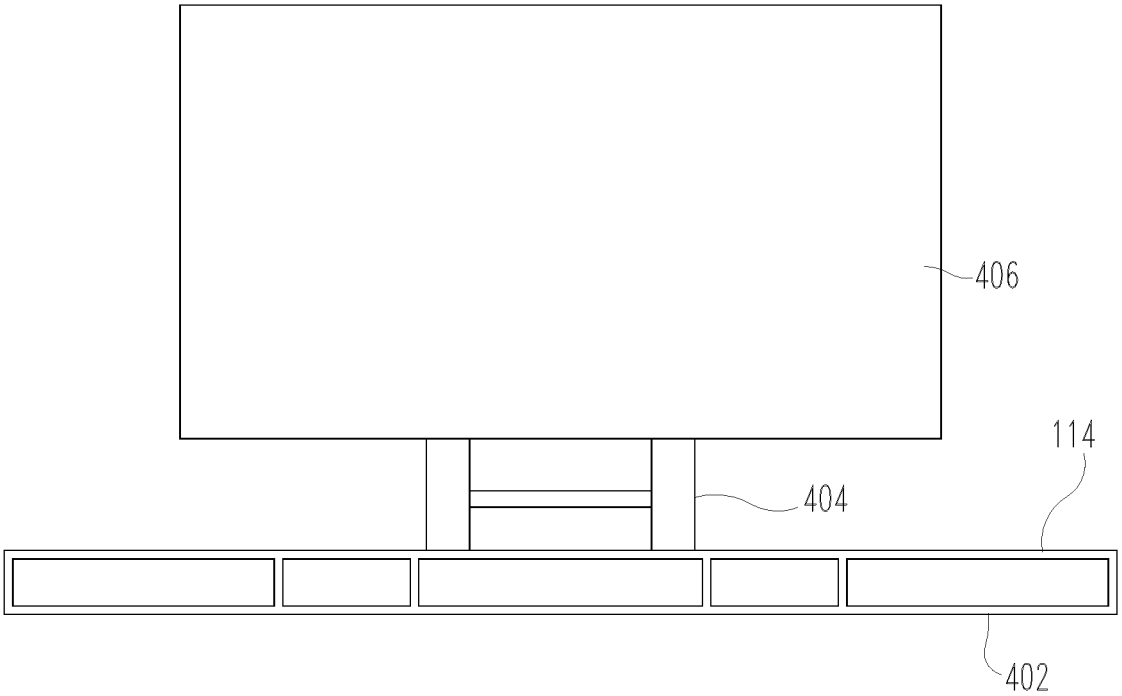
FIG. 4 is a schematic elevation view of an engine mounted to a fixture on the fixture plate.

With reference to FIG. 4, there is illustrated a schematic view of a fixture 404 mounted on fixture plate 114. The example implementation in FIG. 4 includes a number of features and aspects which are the same as or similar to the features of the base 102 in FIG. 1, designated as reference numeral 402 in FIG. 4. The fixture plate 404 may be mounted on a fixture plate (e.g., fixture plate 114) for supporting an engine 406 when the fixture plate is secured to the base 402.

Figure 5A:
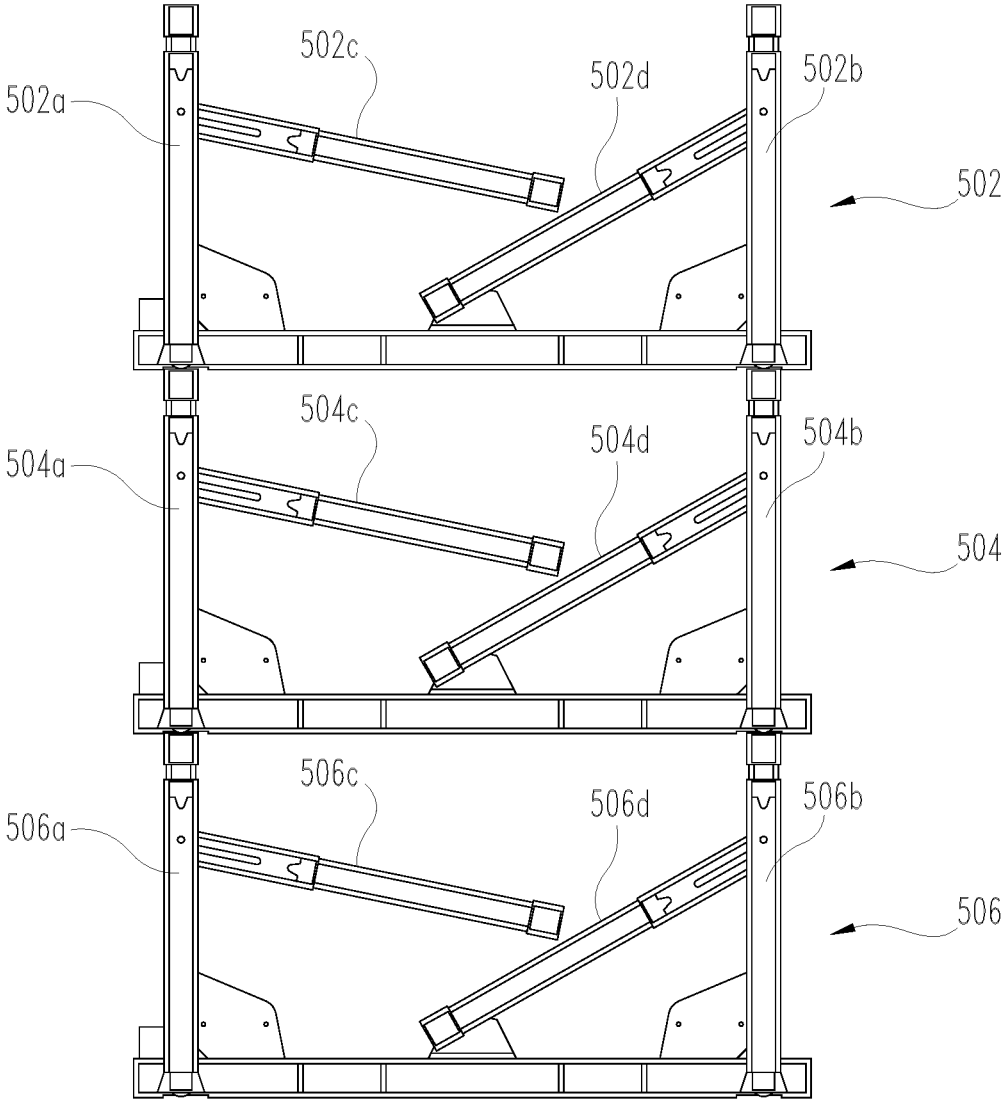
FIGS. 5A and 5B are schematic elevation views of a number empty stacked skids and stacked skids with engines, respectively.
Figure 5B:
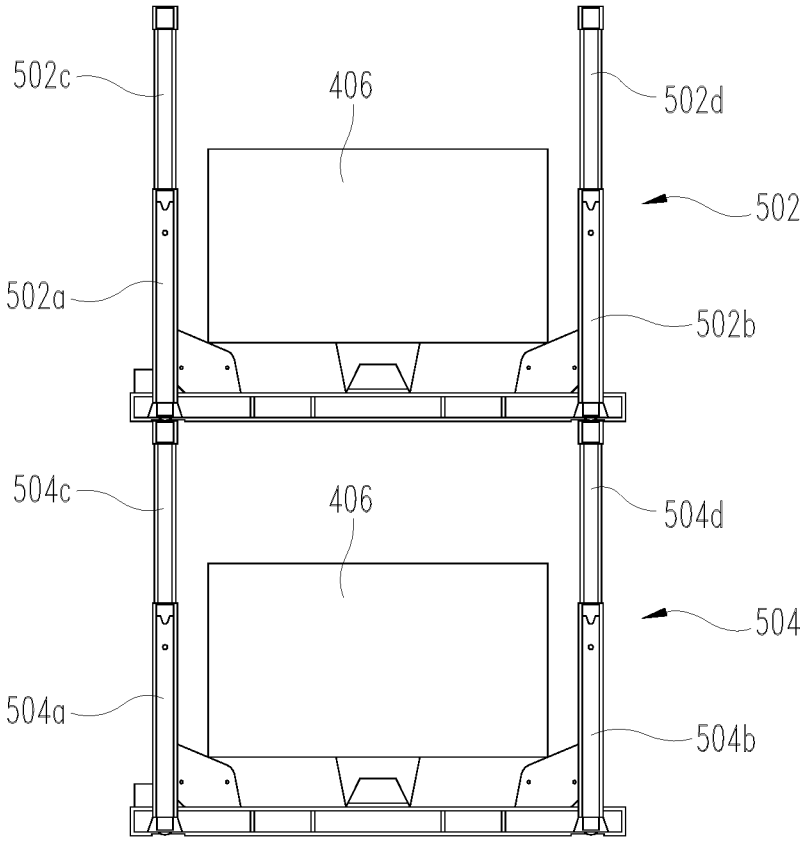

With reference to FIGS. 5A and 5B, there are illustrated schematic views of skids 502, 504, 506 in stacking and shipping positions. The example implementations in FIGS. 5A and 5B include a number of features and aspects which are the same as or similar to the features of the skid 100, designated as reference numerals 502, 504, 506 in FIGS. 5A and 5B. It should be understood one skilled in the art that FIGS. 5A and 5B are side views and that the skids are supported by all of the vertically extending support members of the respective skid and/or their respective detachable vertical post members. In FIG. 5A, skids 502, 504, 506 are stacked and supported on top of one another by vertically extending support members of a lower placed skid, without engines on the skid and with vertical post members in a collapsed position to allow stacking of three or more skids 502, 504, 506. For example, skid 502 having vertically extending support members 502*a*, 502*b* and vertical post members 502*c*, 502*d*, is stacked on top of skid 504 and supported by the respective vertically extending support members 504*a*, 504*b* of skid 504 when the respective vertical post members 504*c*, 504*d* of the support members 504*a*, 504*b* are in the collapsed position. Similarly, skid 504 is stacked on top of skid 506 and supported by the respective vertically extending support members 506*a*, 506*b* of skid 506 when the respective vertical post members 506*c*, 506*d* of the support members 506*a*, 506*b* are in the collapsed position. Additional empty skids may be stacked as may be allowed by the shipping container and allowable load for the vertical support members.

In FIG. 5B, skids 502, 504 are stacked and supported on top of one another by vertically extending support members of a lower placed skid, with engines 406 on the skids and with vertical post members in an upright position to provide the necessary height for stacking of skids with engines for shipping. For example, skid 502 is stacked on top of skid 504 and supported by the vertical post members 504*c*, 504*d* of respective vertically extending support members 504*a*, 504*b* of skid 504. Additional loaded skids may be stacked as may be allowed by the shipping container and allowable load for the vertical support members.

Various aspects and embodiments of the present disclosure are contemplated. One or more aspects and/or embodiments may be combined with one or more other aspects and/or embodiments.

For example, one aspect includes a modular shipping skid for supporting an engine. The modular skipping skid includes a base sized to receive the engine thereon, at least one alignment member projecting from the base, and a plurality of vertically extending support members extending from the base. The modular shipping skid also includes a fixture plate having an opening provided thereon to fit a profile of the at least one alignment member and secure the fixture plate onto the base.

In one embodiment, each of the plurality of vertically extending support members includes a post member that is adjustable along a portion of the respective vertically extending support member to one of a plurality of positions. In one embodiment, the post member is collapsible relative to the vertically extending support member. In one embodiment, the base is rectangular with a plurality of outer corners and each of the corners includes a respective one of the plurality of support members.

In one embodiment, the modular shipping skid includes at least one locking mechanism to lock the fixture plate to the base. In one embodiment, the at least one locking mechanism includes a pin that is attached to the base and is movable from a first position allowing the fixture plate to be placed on the base to a second position in which the pin extends over the fixture plate to secure the fixture place to the base. In one embodiment, the pin is spring-loaded toward the second position. In one embodiment, the at least one locking mechanism includes a plurality of locking mechanisms positioned around the base.

In one embodiment, the base includes at least four sides, each side including at least one entry slot with an entrance parallel to the fixture plate to receive a lifting device. In one embodiment, the at least one alignment member includes a length extending along the base, a width extending across the base, and a height extending vertically from the base. In one embodiment, at least one of the width and the length of the at least one alignment member tapers along the height of the at least one alignment member. In one embodiment, each of the width and the length of the at least one alignment member tapers along the height of the at least one alignment member.

In one embodiment, the fixture plate includes a fixture for supporting the engine on the fixture plate with the fixture plate is secured to the base. In one embodiment, the plurality of support members are configured to support a second modular engine skid positioned on outer ends of the plurality of support members. In one embodiment, the base is sized to accept a range of engines having different sizes, and wherein a different fixture plate is provided for each size of engine within the range of engines.

According to another aspect of the present disclosure, a method for supporting an engine for shipping comprises: providing a base sized to receive the engine thereon, wherein the base includes at least one alignment member projecting from the base, and the base includes a plurality of vertically extending support members extending therefrom; positioning a fixture plate over the at least one alignment member to secure the fixture plate to the base, the fixture plate including an opening to interfit with a profile of the at least one alignment member; and supporting the engine on the fixture plate with the fixture plate secured to the base.

In one embodiment, the at least one alignment member includes a length extending along the base, a width extending across the base, and a height extending vertically from the base, and at least one of the width and the length of the at least one alignment member tapers along the height of the at least one alignment member. In one embodiment, the engine is supported on a fixture that is secured to the fixture plate.

In one embodiment, the method includes selecting the fixture plate from a first fixture plate and a second fixture plate that are each configured to interfit with the profile of the at least one alignment member. The first fixture plate supports a first engine having a first size and the second fixture plate supports a second engine having a second size greater than the first size.

In one embodiment, the method includes stacking a second base including a second fixture plate secured thereto that supports a second engine on the plurality of vertically extending support members.

While illustrative embodiments of the disclosure have been illustrated and described in detail in the drawings and foregoing description, the same is to be considered as illustrative and not restrictive in character, it being understood that only certain exemplary embodiments have been shown and described and that all changes and modifications that come within the spirit of the claimed inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A modular shipping skid for supporting an engine, comprising:

a base sized to receive the engine thereon;

an alignment member integrally formed with and projecting from the base, the alignment member including a profile configured to provide a predetermined orientation;

a plurality of vertically extending support members extending from the base; and a plurality of fixture plates, each of the plurality of fixture plates having a different type of fixture for supporting the engine, and each of the plurality of fixture plates having an opening provided thereon that is configured to fit the profile of the alignment member projecting from the base in the predetermined orientation in order to secure the fixture plate onto the base.

2. The modular shipping skid of claim 1, wherein each of the plurality of vertically extending support members includes a post member that is adjustable along a portion of the respective vertically extending support member to one of a plurality of positions.

3. The modular shipping skid of claim 2, wherein the post member of each of the plurality of vertically extending support members is collapsible relative to the respective vertically extending support member.

4. The modular shipping skid of claim 2, wherein the base is rectangular with a plurality of outer corners and each of the corners includes a respective one of the plurality of support members.

5. The modular shipping skid of claim 1, further comprising at least one locking mechanism to lock the fixture plate to the base.

6. The modular shipping skid of claim 5, wherein the at least one locking mechanism includes a pin that is attached to the base and is movable from a first position allowing the fixture plate to be placed on the base to a second position in which the pin extends over the fixture plate to secure the fixture place to the base.

7. The modular shipping skid of claim 6, wherein the pin is spring-loaded toward the second position.

8. The modular shipping skid of claim 5, wherein the at least one locking mechanism includes a plurality of locking mechanisms positioned around the base.

9. The modular shipping skid of claim 1, wherein the base includes at least four sides, each side including at least one entry slot with an entrance parallel to the fixture plate to receive a lifting device.

10. The modular shipping skid of claim 1, wherein the at least one alignment member includes a length extending along the base, a width extending across the base, and a height extending vertically from the base.

11. The modular shipping skid of claim 10, wherein at least one of the width and the length of the at least one alignment member tapers along the height of the at least one alignment member.

12. The modular shipping skid of claim 10, wherein each of the width and the length of the at least one alignment member tapers along the height of the at least one alignment member.

13. The modular shipping skid of claim 1, wherein the alignment member is a single alignment member located at a center of the base.

14. The modular shipping skid of claim 1, wherein the plurality of support members are configured to support a second modular engine skid positioned on outer ends of the plurality of support members.

15. The modular shipping skid of claim 1, wherein the base is configured to receive a range of engines of different sizes, and wherein a different one of the plurality of fixture plates is provided for each size of engine within the range of engines and configured to be mounted on the base.

16. A method for supporting an engine for shipping, comprising:

providing a base sized to receive the engine thereon, wherein the base includes an alignment member integrally formed with and projecting from the base, the alignment member including a profile configured to provide a predetermined orientation and the base includes a plurality of vertically extending support members extending therefrom;

providing a plurality of fixture plates, each of the plurality of fixture plates having a different type of fixture for supporting the engine;

positioning one of the plurality of fixture plates over the alignment member to secure the one of the plurality of fixture plates to the base, each of the plurality of fixture plates including an opening to interfit with the profile of the alignment member projecting from the base in the predetermined orientation; and supporting the engine on the one of the plurality of fixture plates with the fixture plate secured to the base.

17. The method of claim 16, wherein the at least one alignment member includes a length extending along the base, a width extending across the base, and a height extending vertically from the base, and at least one of the width and the length of the at least one alignment member tapers along the height of the at least one alignment member.

18. The method of claim 16, further comprising:

wherein the plurality of fixture plates comprises a first fixture plate and a second fixture plate that are each configured to interfit with the profile of the at least one alignment member, wherein the first fixture plate supports a first engine having a first size and the second fixture plate supports a second engine having a second size greater than the first size.

19. The method of claim 16, further comprising:

stacking a second base including a second fixture plate secured thereto that supports a second engine on the plurality of vertically extending support members.

* * * * *